US008662824B2

(12) United States Patent
Chatelois et al.

(10) Patent No.: US 8,662,824 B2
(45) Date of Patent: Mar. 4, 2014

(54) ROTOR CONTAINMENT STRUCTURE FOR GAS TURBINE ENGINE

(75) Inventors: Bruno Chatelois, Boucherville (CA); Guy Bouchard, Mont Saint-Hilaire (CA); Yves Martin, Boucherville (CA)

(73) Assignee: Pratt & Whitney Canada Corp., Longueuil (CA)

( * ) Notice: Subject to any disclaimer, the term of this patent is extended or adjusted under 35 U.S.C. 154(b) by 865 days.

(21) Appl. No.: 12/695,180

(22) Filed: Jan. 28, 2010

(65) Prior Publication Data

US 2011/0179805 A1 Jul. 28, 2011

(51) Int. Cl.
*F01D 11/18* (2006.01)

(52) U.S. Cl.
USPC ..... 415/115; 415/173.1

(58) Field of Classification Search
USPC ..... 415/9, 173.1, 173.2, 174.1; 416/174
See application file for complete search history.

(56) References Cited

U.S. PATENT DOCUMENTS

| | | | | |
|---|---|---|---|---|
| 4,023,919 A | | 5/1977 | Patterson | |
| 4,242,042 A | | 12/1980 | Schwarz | |
| 4,363,599 A | | 12/1982 | Cline et al. | |
| 4,507,914 A | * | 4/1985 | Rice | 415/178 |
| 5,127,793 A | | 7/1992 | Walker et al. | |
| 5,167,488 A | | 12/1992 | Ciokajlo et al. | |
| 5,281,085 A | | 1/1994 | Lenahan et al. | |
| 5,486,086 A | | 1/1996 | Bellia et al. | |
| 5,516,258 A | | 5/1996 | Newton | |
| 5,685,693 A | | 11/1997 | Sexton et al. | |
| 5,779,442 A | | 7/1998 | Sexton et al. | |
| 5,899,660 A | | 5/1999 | Dodd | |
| 5,906,473 A | | 5/1999 | Sexton et al. | |
| 5,913,658 A | | 6/1999 | Sexton et al. | |
| 6,079,943 A | | 6/2000 | Sexton et al. | |
| 6,082,963 A | | 7/2000 | Sexton et al. | |
| 7,165,937 B2 | | 1/2007 | Dong et al. | |
| 7,269,955 B2 | | 9/2007 | Albers et al. | |
| 7,293,953 B2 | | 11/2007 | Leach et al. | |
| 7,347,661 B2 | | 3/2008 | Phipps et al. | |
| 8,342,798 B2 | * | 1/2013 | Floyd et al. | 415/116 |

FOREIGN PATENT DOCUMENTS

| | | | | |
|---|---|---|---|---|
| GB | 2062117 A | * | 5/1981 | F01D 11/08 |

* cited by examiner

*Primary Examiner* — Richard Edgar
(74) *Attorney, Agent, or Firm* — Norton Rose Fulbright Canada LLP

(57) ABSTRACT

A rotor containment structure for gas turbine engine comprises an inner containment layer having a single integral body defining an annular structure about the rotor, and having a support on the inner surface of the inner containment layer for at least one shroud segment. An outer containment layer provides containment strength to contain blade fragments and defining an annular structure about the inner containment layer. Air passage through the outer containment layer for air to pass from an exterior of the outer containment layer to an interior of the outer containment layer; and the inner containment layer being connected at a first end to the outer containment layer with a gap defined between the inner surface of the outer containment layer and the outer surface of the inner containment layer, the gap being in fluid communication with the air passage such that air flows through the gap, beyond a free second end of the inner containment layer.

17 Claims, 2 Drawing Sheets

ROTOR CONTAINMENT STRUCTURE FOR GAS TURBINE ENGINE

TECHNICAL FIELD

The present disclosure relates to gas turbines engines, and more particularly to rotor containment structures for containing blade fragments, and supporting shroud segments while controlling rotor tip clearance.

BACKGROUND OF THE ART

Gas turbine engines commonly have containment envelopes or structures. The containment envelopes or structures are rings that surround rotors in the gas turbine engine, so as to contain released blade fragments, to prevent such fragments from escaping the gas turbine engine. In providing such containment structures, it is desirable to minimize the size of the containment structures, while minimizing any impact on containment capability of the containment structure and while controlling rotor tip clearance through the support of the shroud segments.

SUMMARY OF THE INVENTION

In one aspect, there is provided a rotor containment structure for gas turbine engine comprising: an inner containment layer having a single integral body with an outer surface radially oriented away from a rotor, an inner surface radially oriented toward the rotor to define an annular structure about the rotor, and a support on the inner surface of the inner containment layer for at least one shroud segment; an outer containment layer providing containment strength to contain blade fragments, the outer containment layer having an outer surface radially oriented away from the inner containment layer, and an inner surface radially oriented toward the inner containment layer to define an annular structure about the inner containment layer, and at least one air passage through the outer containment layer for air to pass from an exterior of the outer containment layer to an interior of the outer containment layer; and the inner containment layer being connected at a first end to the outer containment layer with a gap defined between the inner surface of the outer containment layer and the outer surface of the inner containment layer, the gap being in direct fluid communication with the air passage such that air flows through the gap, beyond a free second end of the inner containment layer.

In another aspect, the there is provided a rotor containment structure for gas turbine engine comprising: an inner containment layer having a single integral body with an outer surface radially oriented away from a rotor, an inner surface radially oriented toward the rotor to define an annular structure about the rotor, and a support on the inner surface of the inner containment layer for at least one shroud segment; an outer containment layer providing containment strength to contain blade fragments, the outer containment layer having an outer surface radially oriented away from the inner containment layer, and an inner surface radially oriented toward the inner containment layer to define an annular structure about the inner containment layer, and at least one air passage through the outer containment layer for air to pass from an exterior of the outer containment layer to an interior of the outer containment layer; and the inner containment layer being welded at a first end to the outer containment layer to form an integral structure, with a gap defined between the inner surface of the outer containment layer and the outer surface of the inner containment layer, the gap being in direct fluid communication with the air passage such that air flows into the gap.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
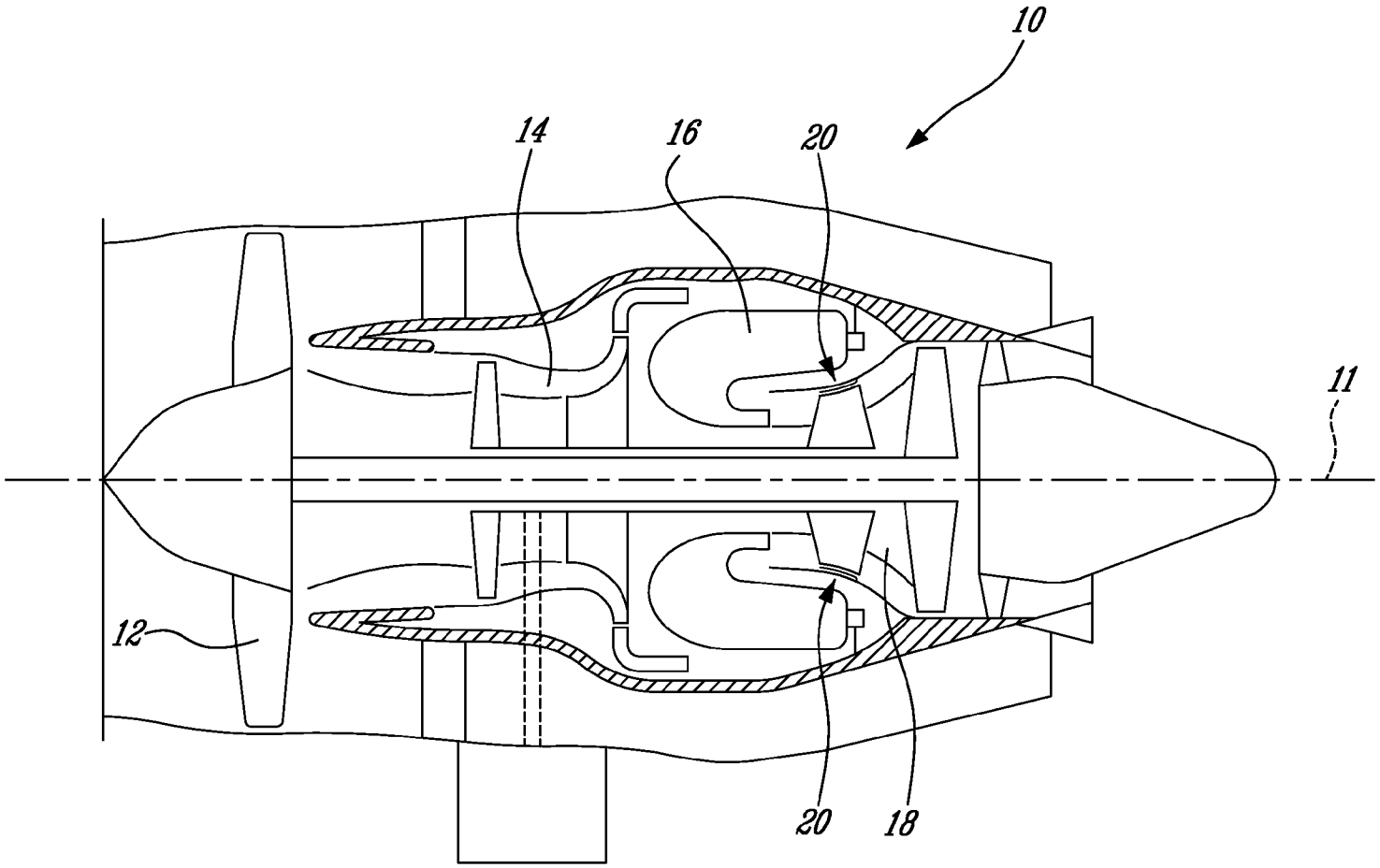
FIG. 1 is a schematic view of a gas turbine engine with a rotor containment structure in accordance with the present disclosure.

FIG. 1 illustrates a turbofan gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. A rotor containment structure of the present disclosure is generally shown at 20, opposite one rotor. The rotor containment structure 20 may be used for any rotor of the gas turbine engine 10 if required.

Figure 2:
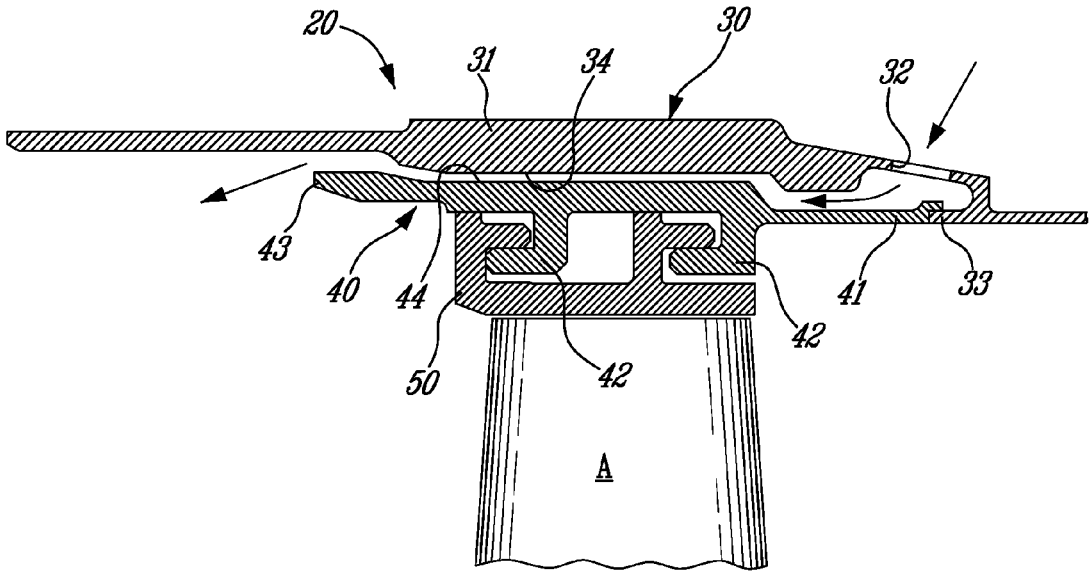
FIG. 2 is a schematic sectional view of a rotor containment structure in accordance with an embodiment of the present disclosure.

Referring to FIG. 2, a rotor containment structure in accordance with the disclosure is generally shown at 20. The rotor containment structure 20 is provided to contain rotor blade fragments from exiting the engine, for safety reasons. The rotor containment structure 20 also supports shroud segments, and controls tip clearance for the rotor blades. The rotor containment structure 20 comprises an outer containment layer 30, and an inner containment layer 40.

The outer containment layer 30 generally defines the outer portion of the structure 20, and provides most of the containment strength to contain blade fragments.

The inner containment layer 40 is a single integral body supporting shroud segments 50 controls the tip clearance of the rotor blades with respect to the shroud segments, and may also contribute to the containment.

The outer containment layer 30 defines an outer annular layer about inner containment layer 40, which in turn defines an outer annular layer with respect to the rotor A. The outer containment layer 30 has a containment portion 31. The containment portion 31 is shown having a greater thickness than a remainder of the layer 30. The containment portion 31 is aligned with the rotor such that blade fragments released by the rotor are contained by the containment portion 31. The greater thickness allows the outer containment layer 30 to have a greater containment strength thereat, whereby no external ring structure may be required outwardly of the outer containment layer 30 to contain blade fragments.

In the embodiment of FIG. 2, cooling holes 32 (i.e., air passages) may be positioned downstream of the containment portion 31. It is pointed out that reference to downstream and upstream refers to the inlet-to-outlet direction of the gas turbine engine 10, unless stated otherwise. The cooling holes 32 allow cooling air to reach the inner containment layer 40 from an exterior of the outer containment layer 30. The cooling air extracts heat from the inner containment layer 40, thereby allowing the control of rotor tip clearance with respect to the shroud segments. In view of controlling the rotor tip clearance, the inner containment layer 40 is made of a material having a suitable thermal expansion coefficient. The cooling holes 32 may be radially distributed in the outer containment layer 30, and may have any suitable shape.

In the embodiment of FIG. 2, a support portion 33 of the outer containment layer 30 is further downstream of the cooling holes 32. The support portion 33 is the interface between the outer containment layer 30 and the inner containment layer 40, and may be defined by an upstream projection as illustrated at FIG. 2, although numerous other configurations are considered. The inner radial surface of the outer containment layer 30, i.e., the surface oriented toward the rotor A, is generally illustrated at 34.

Referring to FIG. 2, the inner containment layer 40 comprises a connection end 41, by which the inner containment layer 40 is connected to the support portion 33 of the outer containment layer 30. The connection end 41 may be welded to the support portion 33, whereby weld-compatible materials are used for the outer containment layer 30 and the inner containment layer 40. Accordingly, the outer containment layer 30 and the inner containment layer 40 form an integral structure. The inner containment layer 40 may be cantilevered to the outer containment layer 30, as illustrated in FIG. 2.

In the embodiment of FIG. 2, a shroud support section of the inner containment layer 40, with shroud support members 42, is positioned upstream of the connection end 41. Any suitable member may be provided in the shroud support section to support shroud segments 50.

The inner containment layer 40 has a free end 43 upstream of the shroud support section. Accordingly, in the embodiment of FIG. 2, the inner containment layer 40 is cantilevered to the outer containment layer 30, with the free end 43 being the cantilevered end of the inner containment layer 40.

The outer radial surface of the inner containment layer 40, i.e., the surface oriented away from the rotor, is generally shown at 44. A gap is defined between the inner surface 34 of the layer 30 and the outer surface 44 of the layer 40. The gap is in fluid communication with the cooling holes 32, whereby cooling air entering through the cooling holes 32 passes through the gap. The gap is opened to an interior of the inner containment layer 40 upstream of the free end 43. Accordingly, cooling air may reach a stator (not shown) upstream of the inner containment layer 40, by passing through the gap.

The gap may have a narrowing portion as illustrated in FIG. 2, to accelerate a flow of cooling air therethrough to enhance cooling of the inner containment layer 40 by the cooling air. As it must provide the containment strength to contain blade fragments, the outer containment layer 30 has a greater mass than the inner containment layer 40. However, as the outer containment layer 30 does not directly support the shroud segments 50, the thermal inertia of the thicker containment portion 31 has a lessened impact or no impact on tip clearance control. The inner containment layer 40, on the other hand, is lighter and therefore responds more efficiently to temperature variations than the outer containment layer 30, thereby improving the control of rotor tip clearance.

Figure 3:
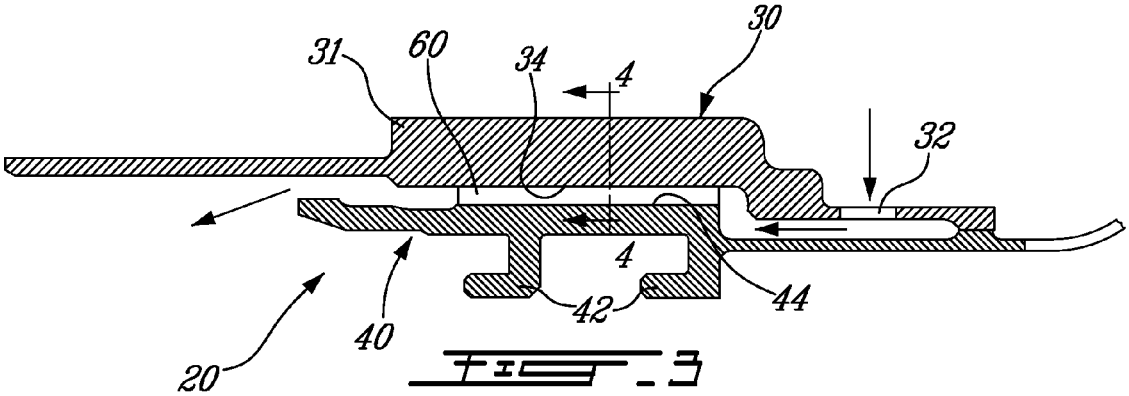
FIG. 3 is a schematic sectional view of a rotor containment structure in accordance with another embodiment of the present disclosure.
Figure 4:
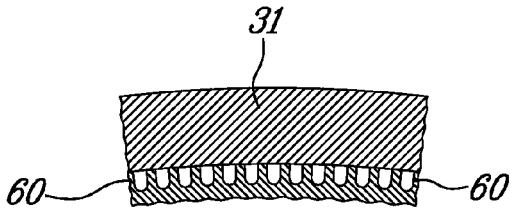
FIG. 4 is a fragmented front view of a fin configuration for the rotor containment structure of FIG. 3.

Referring concurrently to FIGS. 3 and 4, another embodiment of the rotor containment structure 20 is illustrated, with like reference numerals between FIG. 2 and FIGS. 3-4 illustrating like elements. Longitudinal fins 60 project radially from the outer radial surface 44 of the inner containment layer 40. Accordingly, the longitudinal fins 60 are in the gap between layers 30 and 40, but allow cooling air to pass therethrough to reach the stator. The longitudinal fins 60 may contact the inner radial surface 34 of the outer containment layer 30 as illustrated in FIG. 3, at a given temperature. The longitudinal fins 60 are provided to increase a surface of the inner containment layer 40, to enhance heat extraction by the cooling air. The longitudinal fins 60 may be machined into the outer radial surface 44 of the inner containment layer 40, or may be inserted brazed fins, among other possibilities. The fins 60 may be part of outer containment layer 30. The outer radial surface 44 may also have an increased surface roughness or other configurations to improve heat extraction. The inner containment layer 40 may be cast to feature pedestals, trip strips and the like to improve heat extraction.

The above description is meant to be exemplary only, and one skilled in the art will recognize that changes may be made to the embodiments described without department from the scope of the invention disclosed. Still other modifications which fall within the scope of the present invention will be apparent to those skilled in the art, in light of a review of this disclosure, and such modifications are intended to fall within the appended claims.

What is claimed is:

1. A rotor containment structure for gas turbine engine comprising:

an inner containment layer having a single integral body with an outer surface radially oriented away from a rotor, an inner surface radially oriented toward the rotor to define an annular structure about the rotor forming a rotor volume, and a support on the inner surface of the inner containment layer for at least one shroud segment;

an outer containment layer providing containment strength to contain blade fragments, the outer containment layer having an outer surface radially oriented away from the inner containment layer, and an inner surface radially oriented toward the inner containment layer to define an annular structure about the inner containment layer, and at least one air passage from the outer surface of the outer containment layer to the inner surface of the outer containment layer for air to pass from an exterior of the outer containment layer to an interior of the outer containment layer; and the inner containment layer being connected at a first end to the outer containment layer and a second free end, with a gap defined between the inner surface of the outer containment layer and the outer surface of the inner containment layer, the gap having an end away from the air passage open to the rotor volume within the inner surface of the inner containment layer, the gap being in direct fluid communication with the air passage such that air flows through the gap, beyond the free second end of the inner containment layer and into the rotor volume.

2. The rotor containment structure as defined in claim 1, wherein the outer containment layer has a containment portion in radial register with the rotor, the containment portion being thicker than a remainder of the outer containment layer to increase the containment strength.

3. The rotor containment structure as defined in claim 1, wherein the inner containment layer is cantilevered to the outer containment layer, with the second end of the inner containment layer being the cantilevered end.

4. The rotor containment structure as defined in claim 1, wherein the first end of the inner containment layer is downstream of the second end thereof with respect to an orientation of the gas turbine engine.

5. The rotor containment structure as defined in claim 1, wherein the air passage in the outer containment layer is adjacent to the first end of the inner containment layer.

6. The rotor containment structure as defined in claim 1, wherein the first end of the inner containment layer is welded to the inner surface of the outer containment layer.

7. The rotor containment structure as defined in claim 1, wherein the outer containment layer has a support portion projecting from its inner surface for connection with the first end of the inner containment layer.

8. The rotor containment structure as defined in claim 1, wherein heat extraction means are provided on the outer surface of the inner containment layer.

9. The rotor containment structure as defined in claim 8, wherein the heat extraction means are longitudinal fins.

10. A rotor containment structure for gas turbine engine comprising:

an inner containment layer having single integral body with an outer surface radially oriented away from a rotor, an inner surface radially oriented toward the rotor to define an annular structure about the rotor forming a rotor volume, and a support on the inner surface of the inner containment layer for at least one shroud segment;

an outer containment layer providing containment strength to contain blade fragments, the outer containment layer having an outer surface radially oriented away from the inner containment layer, and an inner surface radially oriented toward the inner containment layer to define an annular structure about the inner containment layer, and at least one air passage from the outer surface of the outer containment layer to the inner surface of the outer containment layer for air to pass from an exterior of the outer containment layer to an interior of the outer containment layer; and the inner containment layer being welded at a first end to the outer containment layer to form an integral structure, with a gap defined between the inner surface of the outer containment layer and the outer surface of the inner containment layer, the gap having an end away from the air passage open to the rotor volume within the inner surface of the inner containment layer, the gap being in direct fluid communication with the air passage such that air flows through the gap and into the rotor volume.

11. The rotor containment structure as defined in claim 10, wherein the outer containment layer has a containment portion in radial register with the rotor, the containment portion being thicker than a remainder of the outer containment layer to increase the containment strength.

12. The rotor containment structure as defined in claim 10, wherein the inner containment layer is cantilevered to the outer containment layer, with a second end of the inner containment layer being the cantilevered end.

13. The rotor containment structure as defined in claim 12, wherein the first end of the inner containment layer is downstream of the second end thereof with respect to an orientation of the gas turbine engine.

14. The rotor containment structure as defined in claim 10, wherein the air passage in the outer containment layer is adjacent to the first end of the inner containment layer.

15. The rotor containment structure as defined in claim 10, wherein the outer containment layer has a support portion projecting from its inner surface for connection with the first end of the inner containment layer.

16. The rotor containment structure as defined in claim 10, wherein heat extraction means are provided on the outer surface of the inner containment layer.

17. The rotor containment structure as defined in claim 16, wherein the heat extraction means are longitudinal fins.

* * * * *